US011569618B2

(12) United States Patent
Ito

(10) Patent No.: US 11,569,618 B2
(45) Date of Patent: Jan. 31, 2023

(54) SOCKET FOR HIGH-SPEED TRANSMISSION

(71) Applicant: YAMAICHI ELECTRONICS CO., LTD., Tokyo (JP)

(72) Inventor: Toshiyasu Ito, Tokyo (JP)

(73) Assignee: YAMAICHI ELECTRONICS CO., LTD., Tokyo (JP)

( * ) Notice: Subject to any disclaimer, the term of this patent is extended or adjusted under 35 U.S.C. 154(b) by 50 days.

(21) Appl. No.: 17/333,665

(22) Filed: May 28, 2021

(65) Prior Publication Data

US 2021/0376530 A1 Dec. 2, 2021

(30) Foreign Application Priority Data

Jun. 2, 2020 (CN) ..... 202010489916.3

(51) Int. Cl.
*H01R 13/6471* (2011.01)
*H01R 12/70* (2011.01)

(52) U.S. Cl.
CPC ..... *H01R 13/6471* (2013.01); *H01R 12/70* (2013.01); *H01R 12/707* (2013.01)

(58) Field of Classification Search
CPC .... H01R 12/70; H01R 12/707; H01R 12/714; H01R 13/6471; H01R 13/6461; H01R 13/6473; H01R 13/6477; H01R 13/6599; H01R 13/6591; H01R 13/6594; H01R 13/6585
USPC ..... 439/65, 86, 91, 90, 607.02
See application file for complete search history.

(56) References Cited

U.S. PATENT DOCUMENTS 5,637,008 A * 6/1997 Kozel ..... H01R 13/193 439/259
7,131,850 B2 * 11/2006 Frutschy ..... H05K 7/1061 439/71
7,429,176 B2 * 9/2008 Johnescu ..... H01R 12/716 439/74
7,918,668 B1 * 4/2011 MacDougall ..... H05K 7/1061 439/66
8,025,531 B1 * 9/2011 Zhang ..... H01R 13/6588 439/607.05
8,465,323 B2 * 6/2013 Jeon ..... H01R 13/6582 439/607.07
8,662,924 B2 * 3/2014 Davis ..... H01R 13/6477 439/607.07

(Continued)

FOREIGN PATENT DOCUMENTS

CN 110165448 A * 8/2019 ..... H01R 12/716
EP 0624928 A1 * 11/1994
JP 2012174616 A 9/2012

*Primary Examiner* — Marcus E Harcum
(74) *Attorney, Agent, or Firm* — Hayes Soloway PC

(57) ABSTRACT

A socket having a housing, a plurality of contacts, a plurality of insulating members and a plurality of conductive resin members is described. The housing is in a box shape with an opening and is provided with a matrix of penetration holes at a bottom portion. The plurality of contacts include contacts for ground and respective pairs of contacts for high-speed differential transmission. The plurality of insulating members support the plurality of contacts and are pressed into the housing so that the contacts are exposed on an opposite side of the opening from the penetration holes of the housing. The plurality of conductive resin members are fitted at positions of the plurality of insulating members in contact with the contacts for ground.

10 Claims, 15 Drawing Sheets

(56) References Cited

U.S. PATENT DOCUMENTS

| | | | | |
|---|---|---|---|---|
| 8,851,904 | B2 * | 10/2014 | Chang | H05K 7/1069 439/71 |
| 9,048,591 | B2 * | 6/2015 | Chang | H01R 13/6597 |
| 9,065,216 | B2 * | 6/2015 | Chang | H01R 13/6585 |
| 9,071,025 | B2 * | 6/2015 | Uozumi | H01R 43/00 |
| 9,491,881 | B2 * | 11/2016 | Heppner | H05K 7/1069 |
| 9,780,510 | B2 * | 10/2017 | Athreya | H01L 23/49827 |
| 9,831,582 | B2 * | 11/2017 | Ito | H01R 12/88 |
| 10,135,162 | B1 * | 11/2018 | Hejase | H01R 12/7076 |
| 10,135,199 | B1 * | 11/2018 | Ju | H01R 12/7082 |
| 10,236,635 | B2 * | 3/2019 | Ju | H01R 12/714 |
| 10,454,218 | B2 * | 10/2019 | Hsu | H01R 13/428 |
| 10,483,666 | B2 * | 11/2019 | Taguchi | H05K 7/1038 |
| 10,553,969 | B2 * | 2/2020 | Hwang | H01R 12/714 |
| 10,707,606 | B2 * | 7/2020 | Ho | H01R 13/64 |
| 10,777,921 | B2 * | 9/2020 | Lu | H01R 12/7005 |
| 11,108,194 | B2 * | 8/2021 | Lin | H01R 13/6471 |
| 11,289,836 | B2 * | 3/2022 | O'Connell | H01R 43/20 |
| 11,296,445 | B2 * | 4/2022 | Shen | H01R 13/6599 |
| 11,316,304 | B2 * | 4/2022 | Chen | H01R 13/6598 |
| 11,336,045 | B2 * | 5/2022 | Yamada | H01R 12/58 |
| 2005/0170700 | A1 * | 8/2005 | Shuey | H01R 13/6477 439/701 |
| 2012/0202387 | A1 * | 8/2012 | McNamara | H01R 13/516 439/629 |
| 2018/0366881 | A1 * | 12/2018 | Chang | H01R 13/41 |
| 2018/0375262 | A1 * | 12/2018 | Ju | H01R 12/57 |
| 2019/0052021 | A1 * | 2/2019 | Hsu | H01R 13/2442 |
| 2019/0067876 | A1 * | 2/2019 | Tang | H01R 13/6587 |
| 2019/0207346 | A1 * | 7/2019 | Ju | H01R 12/714 |
| 2020/0212631 | A1 * | 7/2020 | Buck | H01R 24/28 |
| 2020/0266585 | A1 * | 8/2020 | Paniagua | H01R 13/652 |
| 2020/0412060 | A1 * | 12/2020 | Hsieh | H01R 13/6471 |
| 2022/0149568 | A1 * | 5/2022 | Tan | H01R 13/41 |

* cited by examiner

SOCKET FOR HIGH-SPEED TRANSMISSION

CROSS-REFERENCE TO RELATED APPLICATION

This application claims the benefit of Chinese Patent application CN202010489916.3 filed on Jun. 2, 2020, the contents of which are incorporated herein by reference herein.

TECHNICAL FIELD

The present invention relates to a socket for high-speed transmission to be mounted on a circuit board.

BACKGROUND

Some LGA (Land grid array) packages are mounted on circuit boards via specialized sockets rather than directly mounted on the circuit boards. As an example of documents disclosing a technique related to this type of socket of LGA package, Japanese Patent Application Publication No. 2012-174616 (hereinafter, referred to as "Patent Document 1). In the socket for electronic component disclosed in Patent Document 1, a metal board with a plurality of penetration holes is used as the bottom of the housing, contacts for signal and contacts for ground arranged in a lattice shape are inserted into the penetration holes of the metal board, and the contacts are fixed to the housing. In this socket for electronic component, a first protruding piece protrudes inward from the inner wall of the penetration hole of the metal board, and the tip of the first protruding piece is in contact with and conducted to the contact for ground. Therefore, the metal board serves as the ground, the electrical reflection noise and congestion noise are shielded by the contact for ground and the metal board, and the shielding performance for the contact for signal is improved.

By the way, some LGA packages perform differential transmission at such a high speed that the transmission rate reaches 112 Gbps. The technology of patent document 1 could not adequately prevent the occurrence of crosstalk in such high speed differential transmission.

The present disclosure has been made in view of such a problem, and one of the objects is to provide a connector which can prevent the occurrence of crosstalk in high-speed differential transmission.

SUMMARY

In accordance with a first aspect of the present disclosure, there is provided a socket including a housing, a plurality of contacts, a plurality of insulating members and a plurality of conductive resin members. The housing is in a box shape with an opening and is provided with a matrix of penetration holes at a bottom portion. The plurality of contacts include contacts for ground and respective pairs of contacts for high-speed differential transmission. The plurality of insulating members support the plurality of contacts and are pressed into the housing so that the contacts are exposed on an opposite side of the opening from the penetration holes of the housing. The plurality of conductive resin members are fitted at positions of the plurality of insulating members in contact with the contacts for ground. The respective pairs of contacts for high-speed differential transmission are arranged in a row direction and a column direction of the matrix separately, the contacts for ground are separately arranged at adjacent positions in the row direction and adjacent positions in the column direction in each of the respective pairs of contacts for high-speed differential transmission to surround the pairs.

DETAILED DESCRIPTION

Figure 1:
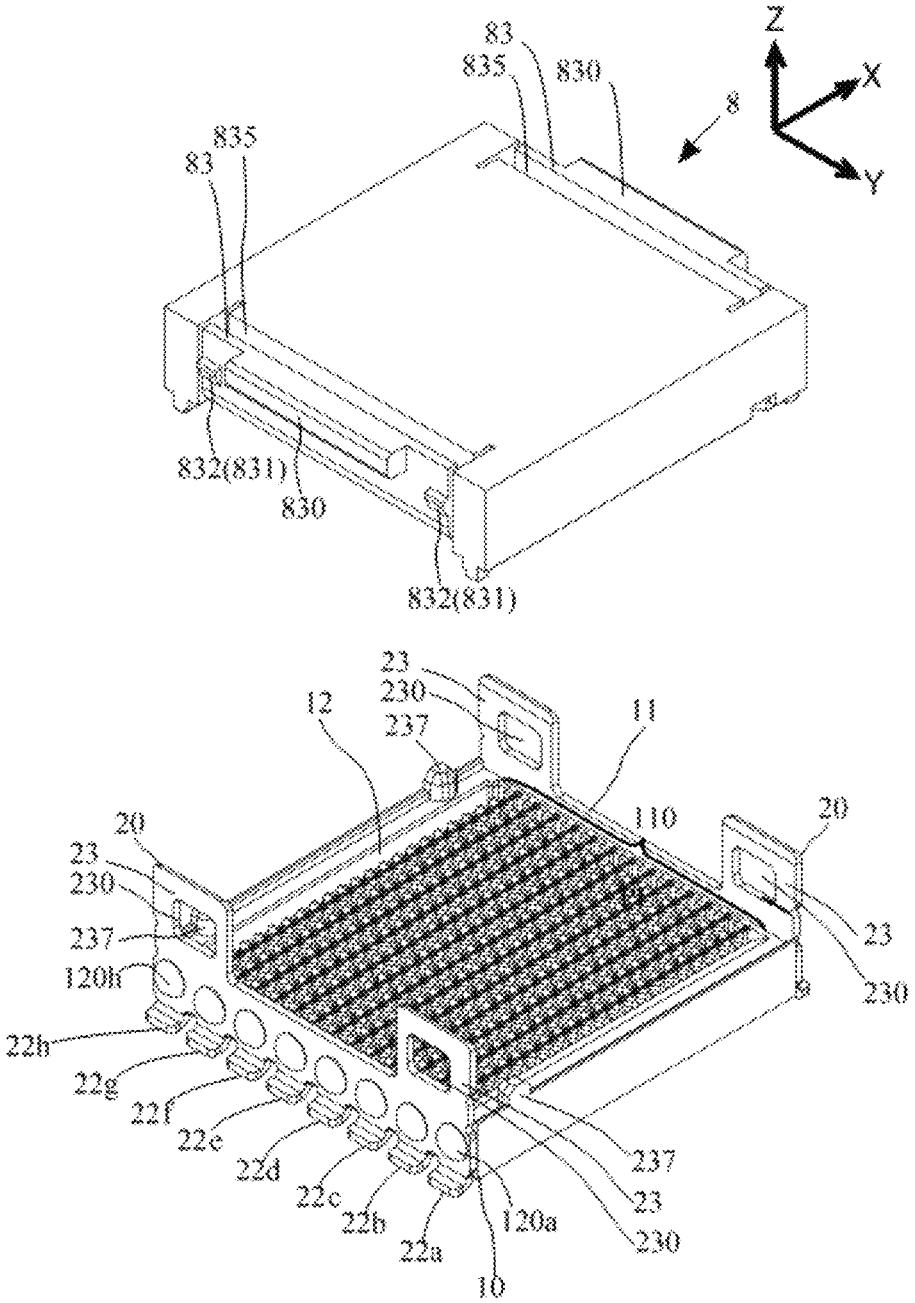
FIG. 1 is a perspective view of a socket and a cap, according to an embodiment of the present disclosure.
Figure 2:
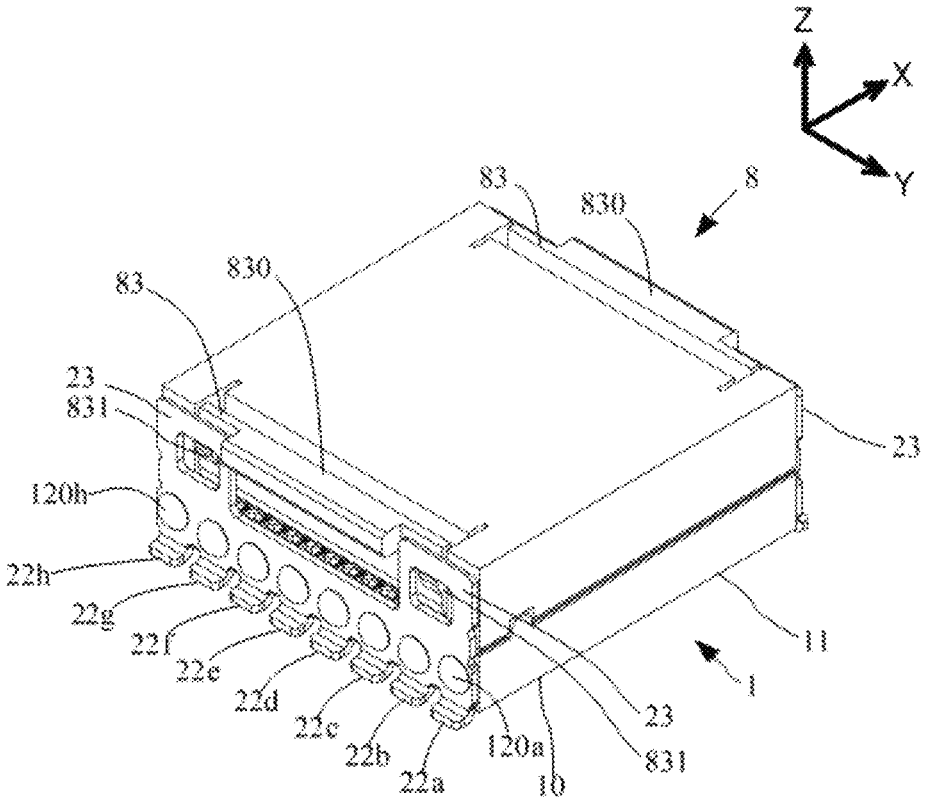
FIG. 2 is a diagram showing a state in which the cap is mounted on the socket of FIG. 1.

Hereinafter, a socket 1 according to one embodiment of the present disclosure is explained with reference to drawings. The socket 1 is mounted on a circuit board 100, and is used by fitting the IC package 9 to the opening 110 on the opposite side of the mounting surface. The IC package 9 is an optical transceiver. The IC package 9 performs a high-speed differential transmission of up to 112 Gbbs by PAM (Pulse Amplitude Modulation) 4.

In the following description, the fitting direction of the IC package 9 to the socket 1 is appropriately referred to as the Z direction, the direction orthogonal to the Z direction is appropriately referred to as the X direction and the direction orthogonal to both the Z direction and the X direction is appropriately referred to as the Y direction. Further, the open side of the opening 110 of the socket 1 in the Z direction is referred to as the upper side, and the rear side is referred to as the lower side.

As shown in FIG. 1, FIG. 3A, FIG. 4A, FIG. 7A, FIG. 7B, FIG. 7C, and FIG. 8, the socket 1 has a housing 10, holders 20, contacts 7, insulating members 40, 50, conductive resin members 60, and insulating supplemental members 69. The housing 10 is formed in a box shape with an opening 110. The housing 10 has a bottom portion 13 forming the bottom of the opening 110, and two pairs of side wall portions 11 and 12 facing each other in the X direction and the Y direction with the opening 110 sandwiched therebetween. The insulating members 40, 50, and the insulating supplemental members 69 are members made of LCP (Liquid Crystal Polymer). The conductive resin members 60 are members made of conductive resin with a conductivity range of 20 S/m to 200 S/m.

Figure 5:
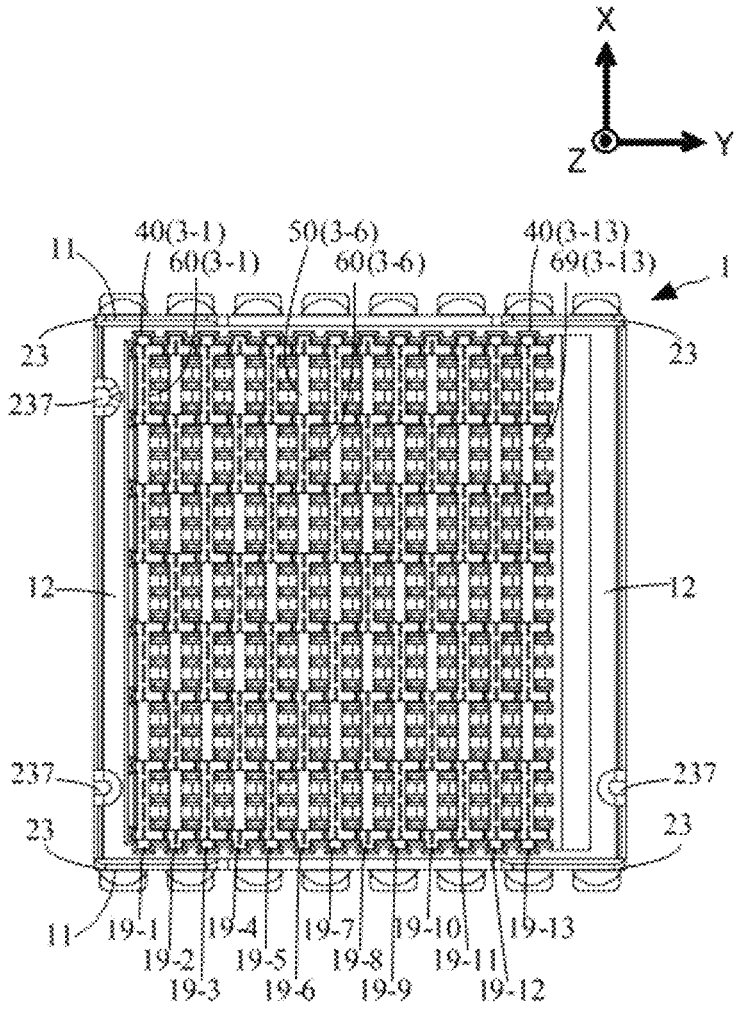
FIG. 5 is a diagram in which the contacts have been removed from FIG. 4A.
Figure 9:
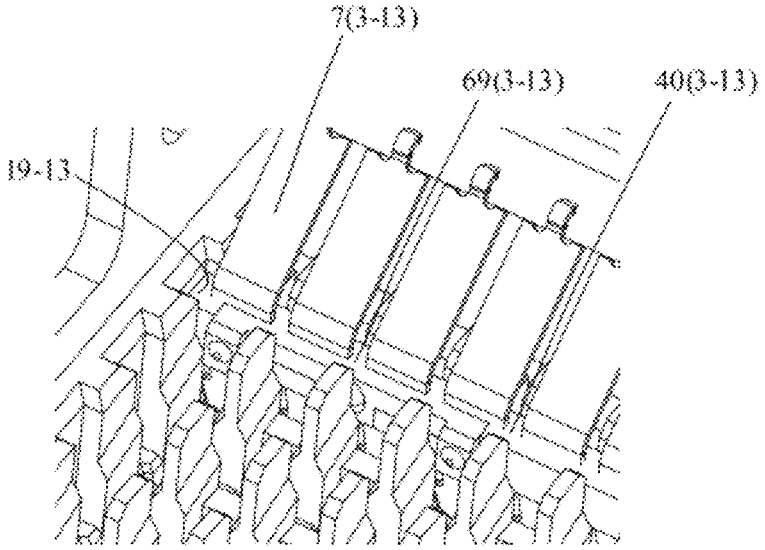
FIG. 9 is an enlarged view of a portion of the socket of FIG. 1.

The bottom portion 13 are provided with a matrix of 22 rows and 13 columns of penetration holes 17-*i* (i=1 to 22)-j (j=1 to 13). As shown in FIG. 5 and FIG. 9, grooves 19-*j* (j=1 to 13) are provided on both sides of the row direction of the matrix of penetration holes 17-*i* (i=1 to 22)-j (j=1 to 13) in the inner surface of the side wall portions 11 facing each other in the X direction.

The side surface of each of the two side wall portions 11 facing each other in the X direction is provided with eight ribs 120*a*, 120*b*, 120*c*, 120*d*, 120*e*, 120*f*, 120*g*, and 120*h*. The cross sections of the ribs 120*a*, 120*b*, 120*c*, 120*d*, 120*e*, 120*f*, 120*g*, and 120*h* have a perfect circular shape. The eight ribs 120*a*, 120*b*, 120*c*, 120*d*, 120*e*, 120*f*, 120*g*, 120*h* of the side wall portions 11 on the ±X sides are passed through eight support holes of the holders 20 on the ±X sides and are fused in the eight support holes.

The portions directly below the eight support holes at the lower ends of the holders 20 extend downward as protruding portions 22*a*, 22*b*, 22*c*, 22*d*, 22*e*, 22*f*, 22*g*, 22*h*. The protruding portions 22*a*, 22*b*, 22*c*, 22*d*, 22*e*, 22*f*, 22*g*, and 22*h* of the holder 20 on the +X side are bent to the +X side, which is the outer side, on the lower side of the lower end of the housing 10. The protruding portion 22*a*, 22*b*, 22*c*, 22*d*, 22*e*, 22*f*, 22*g*, 22*h* of the holder 20 on the −X side is bent to the −X side, which is the outer side, on the lower side of the lower end of the housing 10. The lower surfaces of these bent portions form mounting surfaces to be soldered to the circuit board 100.

Portions apart from each other on the +Y side and the −Y side at the upper end of the holder 20 extend upward above the upper end of the housing 10 as protruding portions 23. The protruding portions 23 are provided with rectangular support holes 230. Protruding pieces 831 of the cap 88 and protruding pieces 931 of the IC package 9 are fitted to the support holes 230. More details will be described below.

Figure 4A:
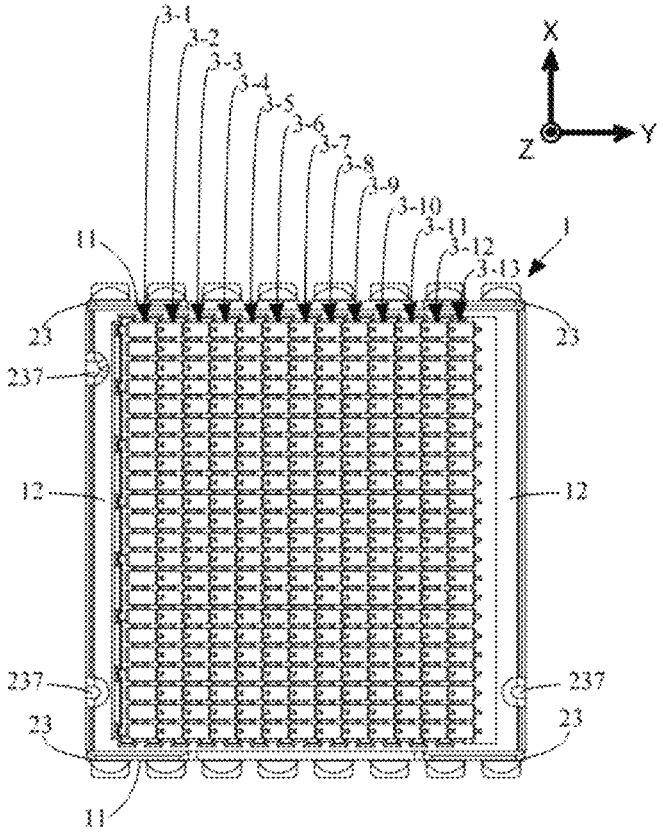
FIG. 4A is a diagram of the socket of FIG. 1 as viewed from a +Z side.

As shown in FIG. 1B, FIG. 4A, and FIG. 5, two positioning pins 237 are provided at the side wall portion 12 of the housing 10 on the −Y side, and one positioning pin 237 is provided at the side wall portion 12 on the +Y side. The positioning pins 237 are fitted to the positioning groove of the cap 8 and the positioning grooves 957, 967 of the IC package 9. More details will be described below.

Figure 6A:
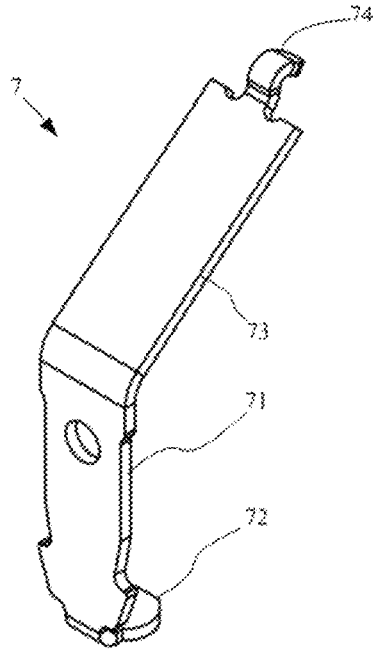
FIG. 6A is a perspective view of the contact of the socket of FIG. 1.

As shown in FIG. 6A, the contact 7 includes: a base portion 71 extending in a straight line in the Z direction; a solder connecting portion 72 bent in an L-shape to the +Y side at the lower end of the base portion 71; an inclined portion 73 bent at an obtuse angle and obliquely extending to the +Y side with respect to the base portion 71 at the upper end of the base portion 71; and a contact portion 74 projecting from the upper end of the inclined portion 73. Here, the contacts 7 include contacts for −signal of high-speed differential transmission, contacts for +signal of high-speed differential transmission, contacts for ground, and contacts for low-speed signal transmission. In the following description, appropriately, letter (N) is attached to the contacts 7 for −signal of high-speed differential transmission, letter (P) is attached to the contacts 7 for +signal of high-speed differential transmission, letter (G) is attached to the contact 7 for ground 7, and letter (S) is attached to the contact 7 for low-speed signal.

The contacts 7 are arranged so as to form a matrix corresponding to the penetration holes 17-*i* (i=1 to 22)-j (j=1 to 13). The contacts 7 are line up at intervals of 0.65 millimeters. Insulating members 40 or 50, and conductive resin members 60 or insulating supplemental members 69 are formed by insertion molding in the contacts 7 which form each column.

The contacts 7 forming the first column, the third column, the fifth column, the seventh column, the ninth column, and the eleventh column, the insulating members 40, and the conductive resin members 60 are integrated to form assembly bodies 3-1, 3-3, 3-5, 3-7, 3-9, and 3-11 of the first column, the third column, the fifth column, the seventh column, the ninth column, and the eleventh column. The contacts 7 forming the second column, the fourth column, the sixth column, the eighth column, and the tenth column, the insulating members 50, and the conductive resin members 60 are integrated to form assembly bodies 3-2, 3-4, 3-6, 3-8, and 3-10 of the second column, the fourth column, the sixth column, the eighth column, and the tenth column. The contacts 7 forming the thirteenth column, the insulating members 40, and the insulating supplemental members 69 are integrated to form assembly bodies 3-13, and 3-14 of the thirteenth column, and the fourteenth column.

Then, the insulating members 40, 50 of the assembly bodies are pressed in the grooves 19-*j* (j=1 to 13) of the housing 10 so that the solder connecting portions 72 of the contacts 7 are exposed on the opposite side of the opening 110 from the penetration holes 17-*i* (i=1 to 22)-j (j=1 to 13) of the housing 10.

Figure 4B:
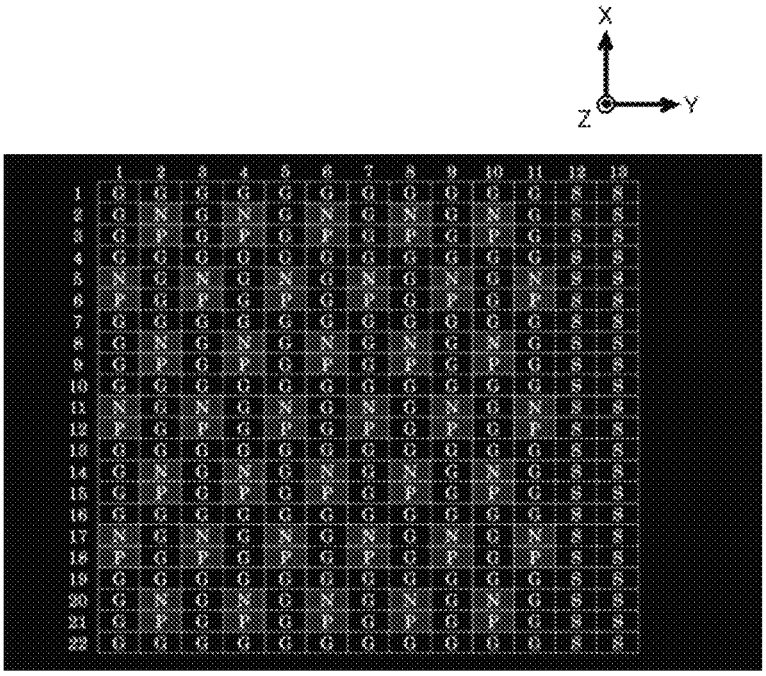
FIG. 4B is a diagram showing an arrangement of contacts in FIG. 4A.

More specifically, as shown in FIG. 4B, the respective pairs of the contacts 7 (N) and the contacts 7 (P) in the first column to the seventh column are arranged apart from each other in the row direction and the column direction. The contacts 7 (G) are arranged at adjacent positions in the column direction and adjacent positions in the row direction in each of the respective pairs of the contacts 7(N) and the contact 7(P), thereby surrounding the pairs.

Figure 7A:
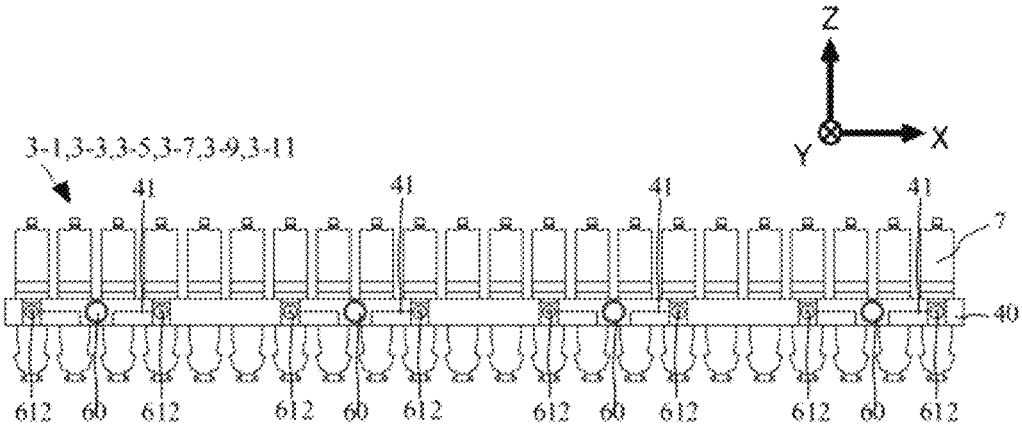
FIG. 7A is a diagram of assembly bodies 3-1, 3-3, 3-5, 3-7, 3-9, and 3-11 of a first column, a third column, a fifth column, a seventh column, a ninth column, and an eleventh column in the socket of FIG. 1 as viewed from a −Y direction.
Figure 7B:
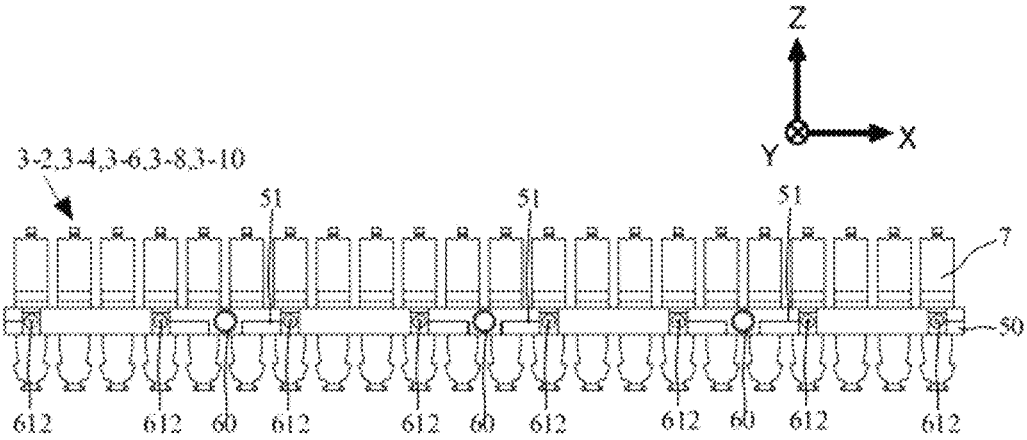
FIG. 7B is a diagram of assembly bodies 3-2, 3-4, 3-6, 3-8, 3-10, and 3-12 of a second column, a fourth column, a sixth column, an eighth column, a tenth column, and a twelfth column as viewed from the −Y direction.
Figure 7C:
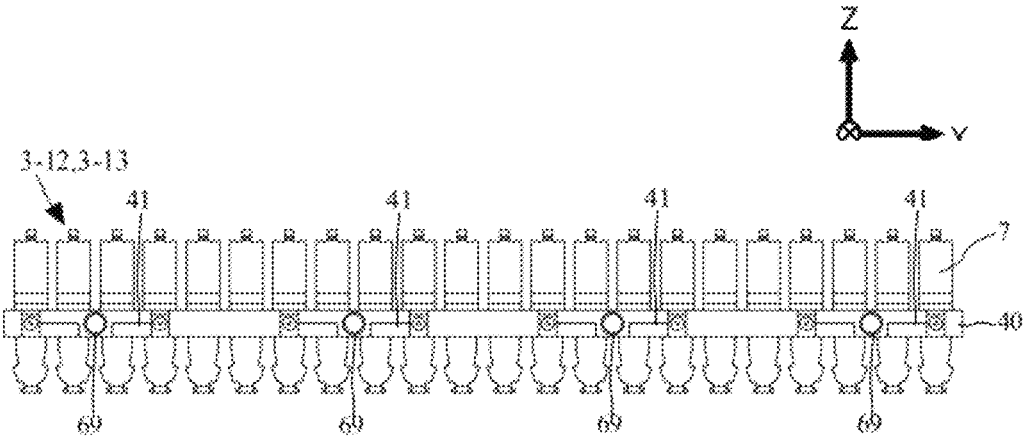
FIG. 7C is a diagram of assembly bodies 3-12 and 3-13 of the twelfth column and a thirteenth column as viewed from the −Y direction.

As shown in FIG. 7A and FIG. 7C, the insulating members 40 of the assembly bodies 3-1, 3-3, 3-5, 3-7, 3-9, 3-11, 3-12, and 3-13 of the first column, the third column, the fifth column, the seventh column, the ninth column, the eleventh column, the twelfth column, and the thirteenth column are in a rod shape extending in the X direction. In the insulating members 40, positions corresponding to the first row to the fourth row, positions corresponding to the seventh row to the tenth row, and positions corresponding to the thirteenth row to the sixteenth row are concaved downward as concave portions 41.

As shown in FIG. 7B, the insulating members 50 of the assembly bodies 3-2, 3-4, 3-6, 3-8, and 3-10 of the second column, the fourth column, the sixth column, the eighth column, and the tenth column are in a rectangular parallelepiped shape with a width in the X direction that is the same as the dimension of the insulating members 40. In the insulating members 50, positions corresponding to the first row, positions corresponding to the fourth row to the seventh row, positions corresponding to the tenth row to the thirteenth row, and positions corresponding to the sixteenth row are concaved downward as concave portions 51.

As shown in FIG. 7A and FIG. 7B, the conductive resin members 60 are fitted to the concave portions 41 of the insulating members 40 of the assembly bodies 3-1, 3-3, 3-5, 3-7, 3-9, and 3-11, and the concave portions 51 of the insulating members 50 of the assembly bodies 3-2, 3-4, 3-6, 3-8, and 3-10. As shown in FIG. 7C, the insulating supplemental members 69 are fitted to the concave portions 41 of the insulating members 40 of the assembly bodies 3-12, and 3-13. As shown in FIG. 5, the position of the conductive resin member 60 on the front side of the column direction, and the position of the conductive resin member 60 on the rear side of the column direction are offset in the row direction by three contacts.

Figure 8:
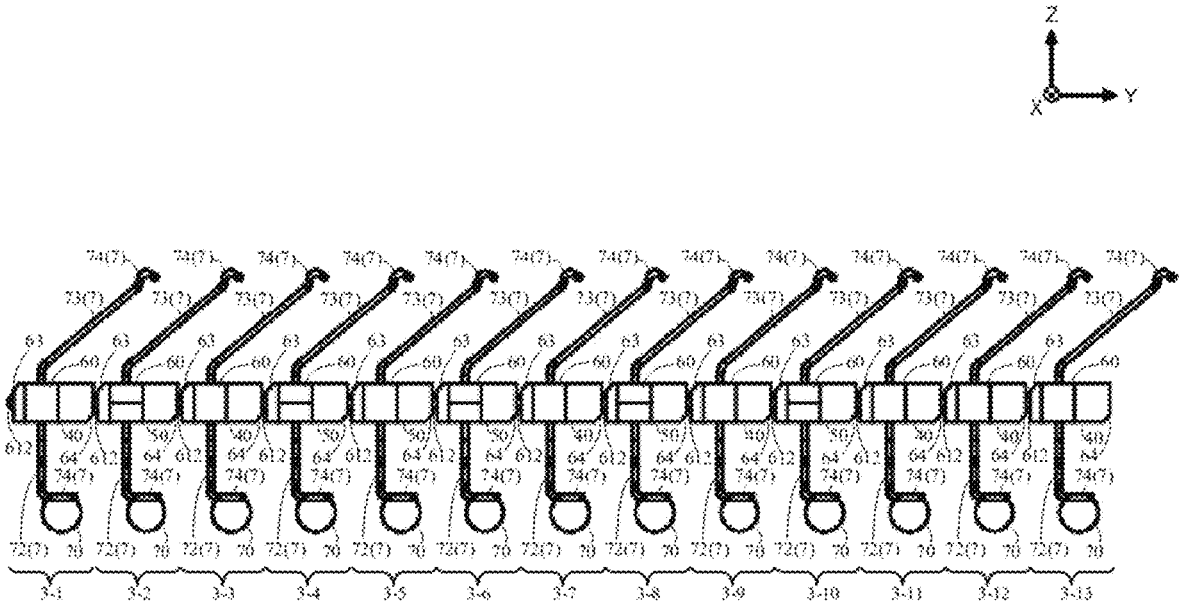
FIG. 8 is a diagram of a cut plane in parallel with an XZ-plane in the assembly bodies **3-*j* (j=1 to 13) of FIG. 4** as viewed from an −X direction.

As shown in FIG. 5 and FIG. 8, the conductive resin member 60 is in a substantially U-shape having a width in the X direction that is the same as the concave portions 41 and 51 of the insulating members 40 and 50 and a width in the Y direction larger than the insulating members 40 and 50. Convex portions 612 protruding to the −Y side are provided slightly inside both end portions of the front surface of the conductive resin member 60 in the Y direction.

The corner portion where the front surface and the upper surface of the conductive resin member 6 intersect with each other and the corner surface where the rear surface and the lower surface intersect with each other are notched. Tapered surfaces 63 and 64 inclined substantially in parallel with the inclined portion 73 are provided on the side of the inclined portion 73 of the contact 7. The insulating supplemental member 69 has the same shape as the conductive resin member 60.

As shown in FIG. 7A, the base portions 71 of the contacts 7 (N) of the fifth row, the contacts 7 (P) of the sixth row, the contacts 7 (N) of the eleventh row, the contacts 7 (P) of the twelfth row, the contacts 7 (N) of the seventeenth row, and the contacts 7 (P) of the eighteenth row of the assembly bodies 3-1, 3-3, 3-5, 3-7, 3-9, and 3-11 penetrate portions of the insulating members 40 to which the conductive resin members 60 are not fitted, and each base portion 71 is supported at the penetrated portion.

Further, the contacts 7 (G) of the first row to the fourth row, the seventh row to the tenth row, the thirteenth row to the sixteenth row, and the nineteenth row to the twenty-second row of the assembly bodies 3-1, 3-3, 3-5, 3-7, 3-9, and 3-11 penetrate portions of the insulating members 50 to which the conductive resin members 60 are fitted, and each base portion 71 is supported at the penetrated portion. The conductive resin members 60 are in contact with the contacts 7 (G) and are not in contact with the contacts 7 (N) and the contacts 7 (P).

As shown in FIG. 7B, the base portions 71 of the contacts 7 (N) of the second row, the contacts 7(P) of the third row, the contacts 7 (N) of the eighth row, the contacts 7 (P) of the ninth row, the contacts 7 (N) of the fourteenth row, the contacts 7 (P) of the fifteenth row, the contacts 7 (N) of the twentieth row, and the contacts 7 (P) of the twenty-first row of the assembly bodies 3-2, 3-4, 3-6, 3-8, and 3-10 penetrate portions of the insulating members 40 to which the conductive resin members 60 are not fitted, and each base portion 71 is supported at the penetrated portion.

Further, the contacts 7 (G) of the first row, the fourth row to the seventh row, the tenth row to the thirteenth row, the sixteenth row to the nineteenth row, and the twenty-second row of the assembly bodies 3-2, 3-4, 3-6, 3-8, and 3-10 penetrate portions of the insulating members 50 to which the conductive resin members 60 are fitted, and each base portion 71 is supported at the penetrated portion. The conductive resin members 60 are in contact with the contacts 7 (G) and are not in contact with the contacts 7 (N) and the contacts 7 (P).

As shown in FIG. 7C, the base portions 71 of the contacts 7 (S) of the fifth row, the contacts 7 (S) of the sixth row, the contacts 7 (S) of the eleventh row, the contacts 7 (S) of the twelfth row, the contacts 7 (N) of the seventeenth row, and the contacts 7 (P) of the eighteenth row of the assembly bodies 3-12 and 3-13 penetrate portions of the insulating members 40 to which the insulating supplemental members 69 are not fitted, and each base portion 71 is supported at the penetrated portion.

The contacts 7 (G) of the first row to the fourth row, the seventh row to the tenth row, the thirteenth row to the sixteenth row, and the nineteenth row to the twenty-second row of the assembly body 3-8 penetrate portions of the insulating members 40 to which the insulating supplemental members 69 are fitted, and each base portion 71 is supported at the penetrated portion.

As shown in FIG. 7A and FIG. 7B, the convex portions 612 of the conductive resin members 60 are on the −Y side of the contacts 7 (S) of the first row, the fourth row, the seventh row, the tenth row, the thirteenth row, and the sixteenth row. Further, as shown in FIG. 8, the rear surface of the conductive resin member 60 on the front side of the column direction is abutted to the convex portion 612 of the conductive resin member 60 on the rear side of the column direction. Therefore, a plurality of conductive resin members 60 in contact with a plurality of contacts for ground 7 (G) surrounding the respective pairs of contacts 7 (N) and contact 7 (P) are in contact with each other, and these plurality of conductive resin members 60 are conducted.

Figure 10A:
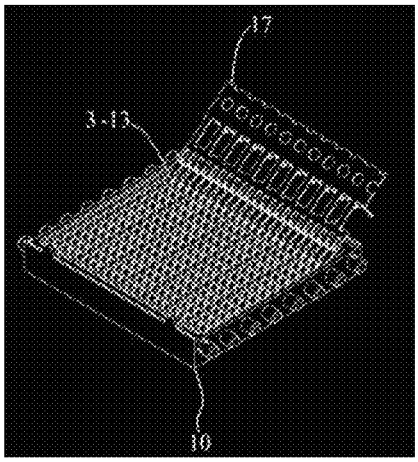
FIGS. 10A, 10B and 10C illustrate a diagram showing procedures of mounting the assembly bodies **3-*j* (j=1 to 13) to the housing of the socket of FIG. 1**.
Figure 10B:
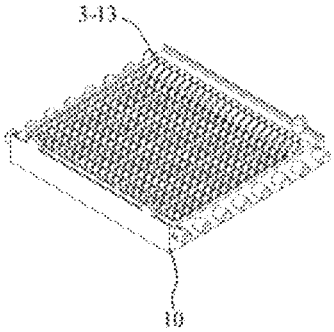

Here, in the assembly process of the socket 1, the assembly bodies **3-*j* may be pressed into the housing 10 successively from the thirteenth column. Specifically, as shown in FIG. 10A, both ends of the assembly body 3-13 with an anchor 17 fixed to the contacts 7 are pressed into grooves 19-13 of the thirteenth column of the housing 10. Next, as shown in FIG. 10B, the anchor 17 of the assembly body 3-13 is folded and removed, and the remainder is reused as the assembly body 3-13** of the thirteenth column.

Figure 10C:
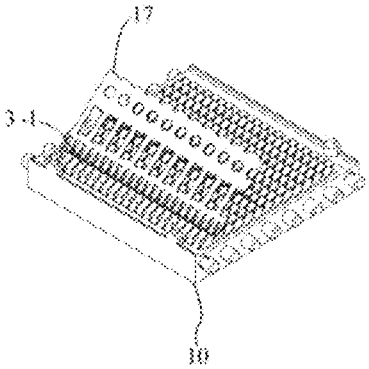

In the same way, the assembly bodies 3-12, 3-11, 3-10, 3-9, 3-8, 3-7, 3-6, 3-5, 3-4, 3-3, and 3-2 of the twelfth column, the eleventh column, the tenth column, the ninth column, the eighth column, the seventh column, the sixth column, the fifth column, the fourth column, the third column, the second column are pressed into the housing 10. Finally, as shown in FIG. 10C, both ends of the assembly body 3-1 with the anchor 17 fixed to the contacts 7 are pressed into the grooves 19-1 of the first column, the anchor 17 of the assembly body 3-1 is folded and removed, and the remainder is reused as the assembly body 3-1 of the first column.

Figure 3A:
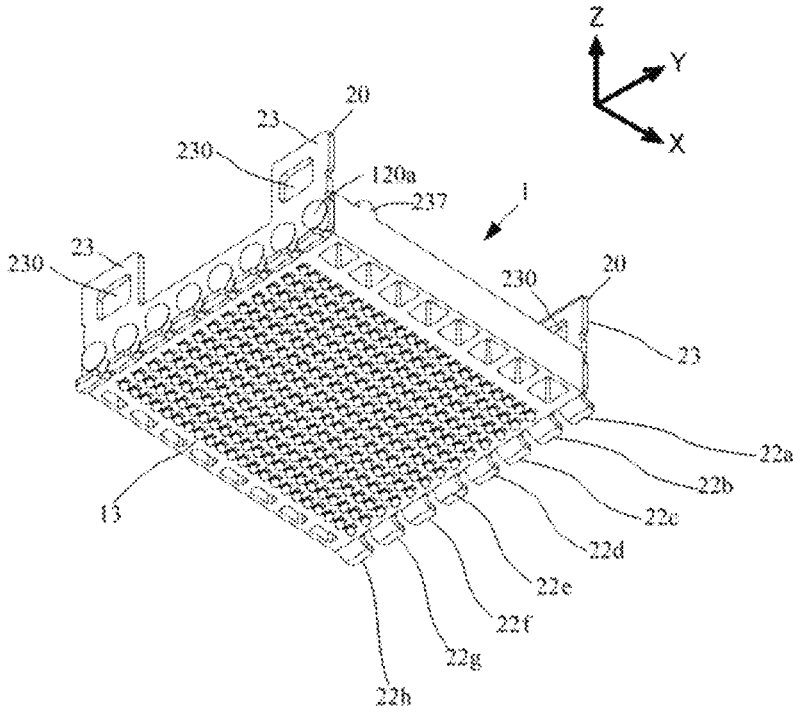
FIG. 3A is a perspective view of the socket of FIG. 1 as viewed from another angle.
Figure 3B:
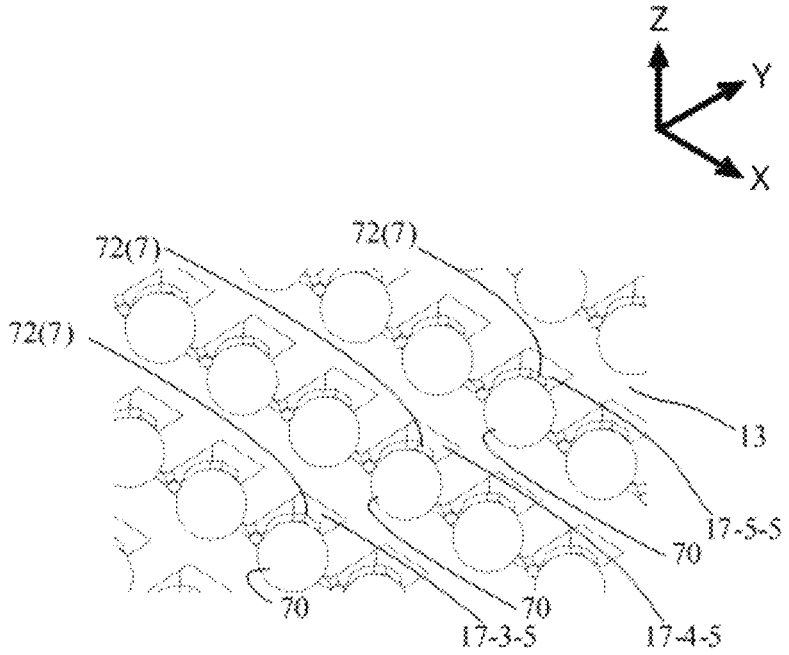
FIG. 3B is an enlarged view of a portion of FIG. 3A.
Figure 6B:
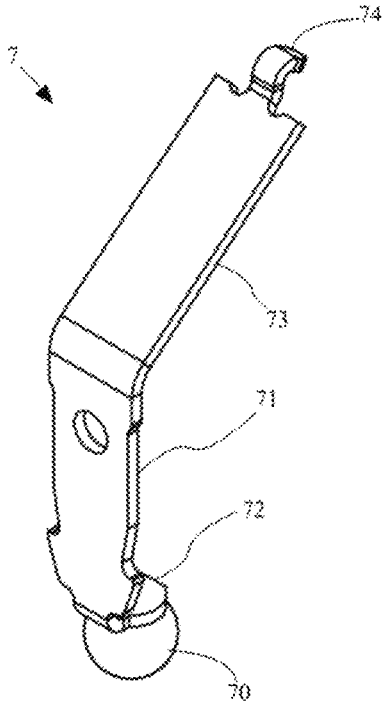
FIG. 6B is a perspective view of the contact of FIG. 7A to which a solder ball is mounted.

As shown in FIG. 6B, the solder ball 70 is fixed to the solder connecting portion 72 of the contact 7. As shown in FIG. 3B, the contacts 7 pass through the penetration holes 17-*i*-*j* of the bottom portion 13 of the housing 10 and extend downward, and the solder connecting portions 72 and the solder balls 70 of the contacts 7 are exposed on the lower side of the lower surface of the bottom portion 13.

As shown in FIG. 1, the cap 8 is in an approximately rectangular parallelepiped shape. Levers 83 are provided in the center of the Y direction on the surfaces of the ±X sides of the cap 8. A rectangular parallelepiped convex portion 830 is provided on the upper side of the center of the outer surface of the lever 83. Further, substantially triangular prism-shaped protruding pieces 831 are provided at positions apart from each other on the +Y side and the −Y side on the outer surface of the lever 83.

The end portions on the outer side of the convex portions 830 and the protruding pieces 831 protrude to an outer side than the surfaces of the cap 8 on the ±X sides. Further, positioning grooves (not shown) are provided at a position near to the +X side of one corner of the lower surface of the cap 8, and respective positions away from this position on the +X side and the +Y side.

When the cap 8 is fitted and pressed down between the protruding portions 23 on the −X side and the protruding portions 23 on the +X side from the above of the opening 110 of the socket 1, the protruding portions 23 push the protruding pieces 831 while sliding on the tapered surfaces 832 of the protruding pieces 831, and the levers 83 is tilted inward while crushing the gaps 835 on the inner side thereof.

When the cap 8 is further pressed down, the protruding pieces 831 of the cap 8 are fitted to the support holes 230 of the socket 1, the levers 83 return to the original positions by their own restoring force, three positioning pins 237 of the socket 1 are fitted to the three positioning grooves of the cap 8, and the cap 8 is supported by the holders 20 of the socket 1. Thereby, the cap 8 is mounted on the socket 1. Further, the cap 8 can be removed from the socket 1 by tilting the levers 83 of the cap 8 inward, releasing the fitting of the protruding pieces 831 and the support holes 230, and lifting the levers 83 up.

Figure 11A:
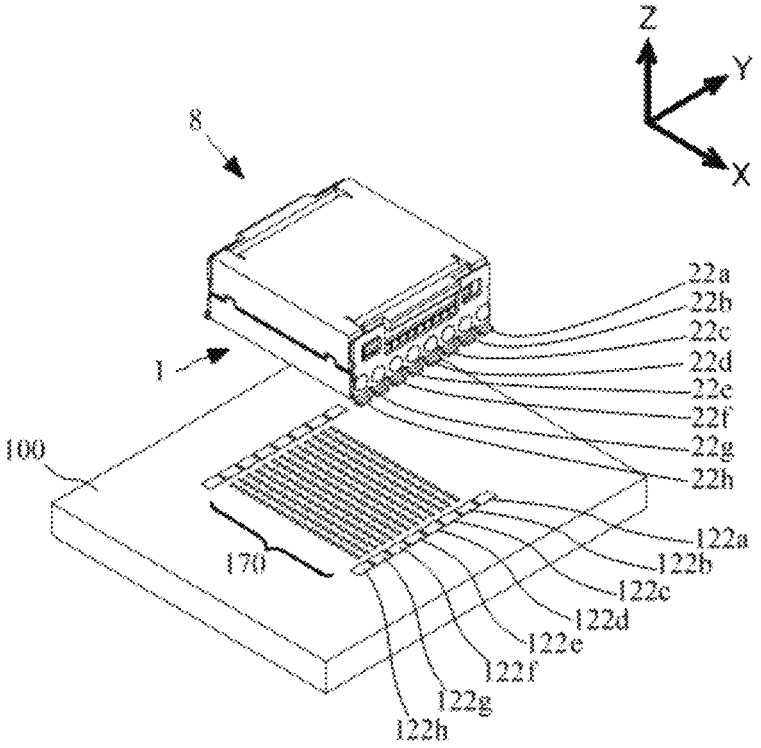
FIGS. 11A and 11B illustrate a diagram showing an appearance of mounting the socket of FIG. 1 to a circuit board.
Figure 11B:
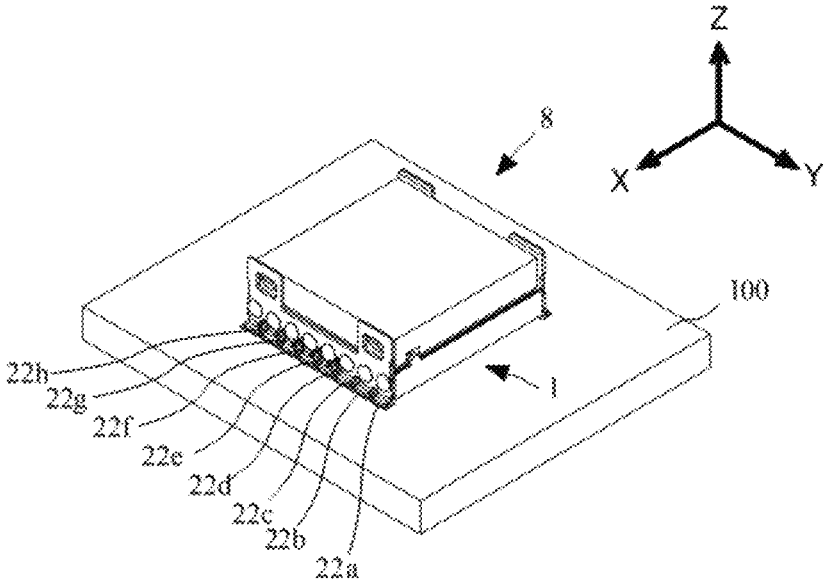

As shown in FIGS. 11A-11B, the socket 1 is placed on the circuit board 100 with the cap 8 mounted and reflow is performed. Lands for housing 122*a*, 122*b*, 122*c*, 122*d*, 122*e*, 122*f*, 122*g*, 122*h* for soldering the protruding portions 22*a*, 22*b*, 22*c*, 22*d*, 22*e*, 22*f*, 22*g*, 22*h* of the housing 10 may be provided on the circuit board 100, in addition to the land for contact 170 for soldering the contacts 7.

Figure 12A:
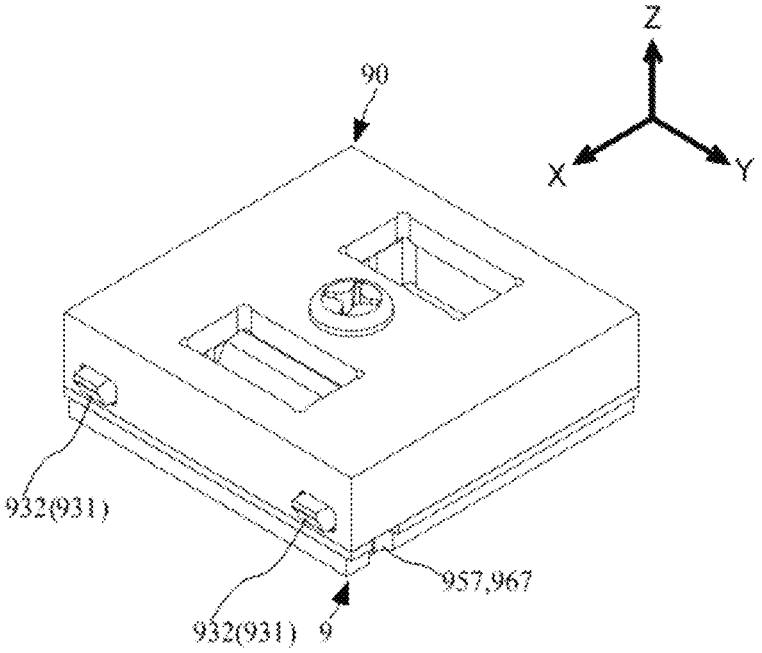
FIG. 12A is a perspective view of an IC package according to an embodiment of the present disclosure.
Figure 12B:
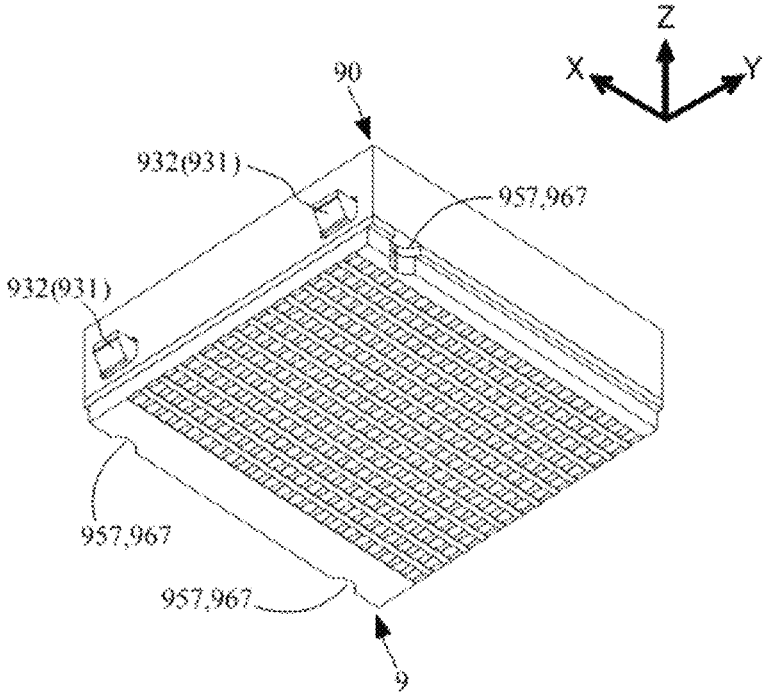
FIG. 12B is a perspective view of the IC package of FIG. 12A as viewed from another angle.
Figure 13:
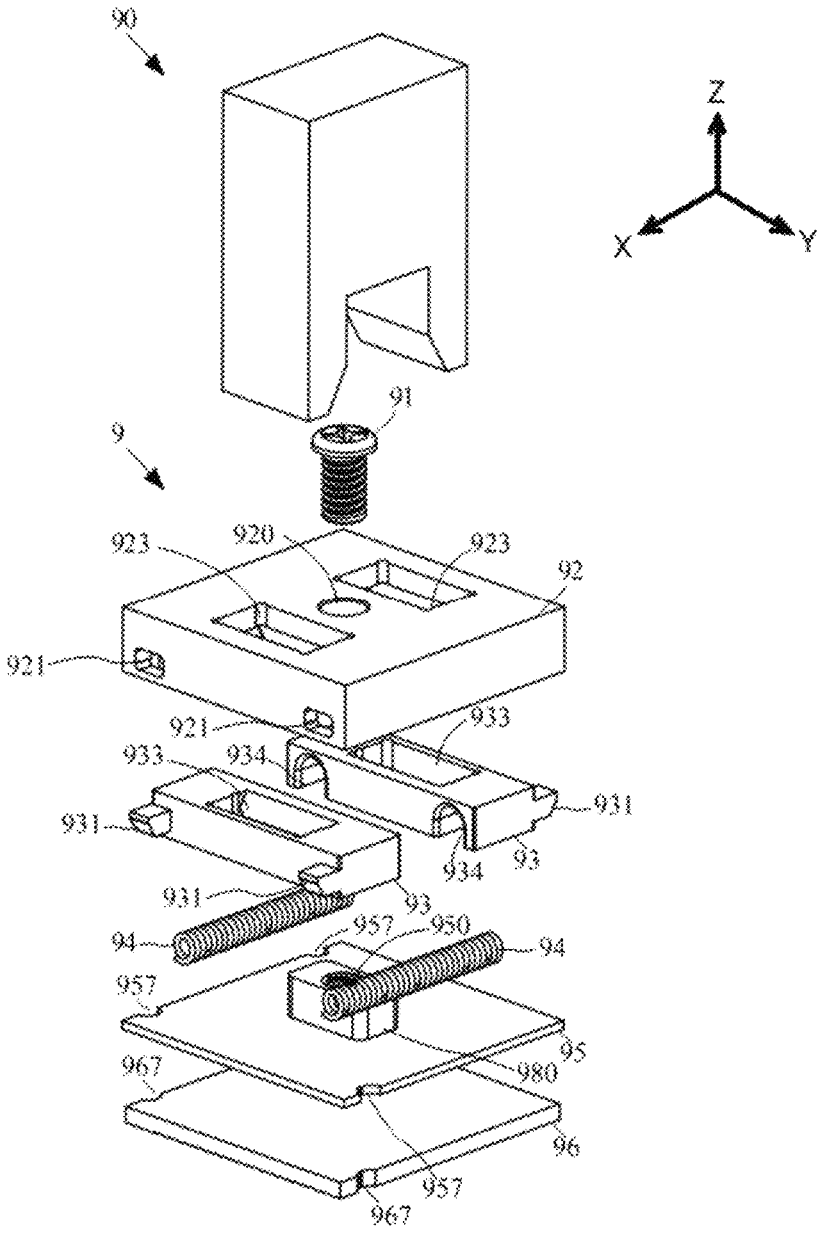
FIG. 13 is an exploded perspective view of the IC package and the remover of FIG. 12A.
Figure 14A:
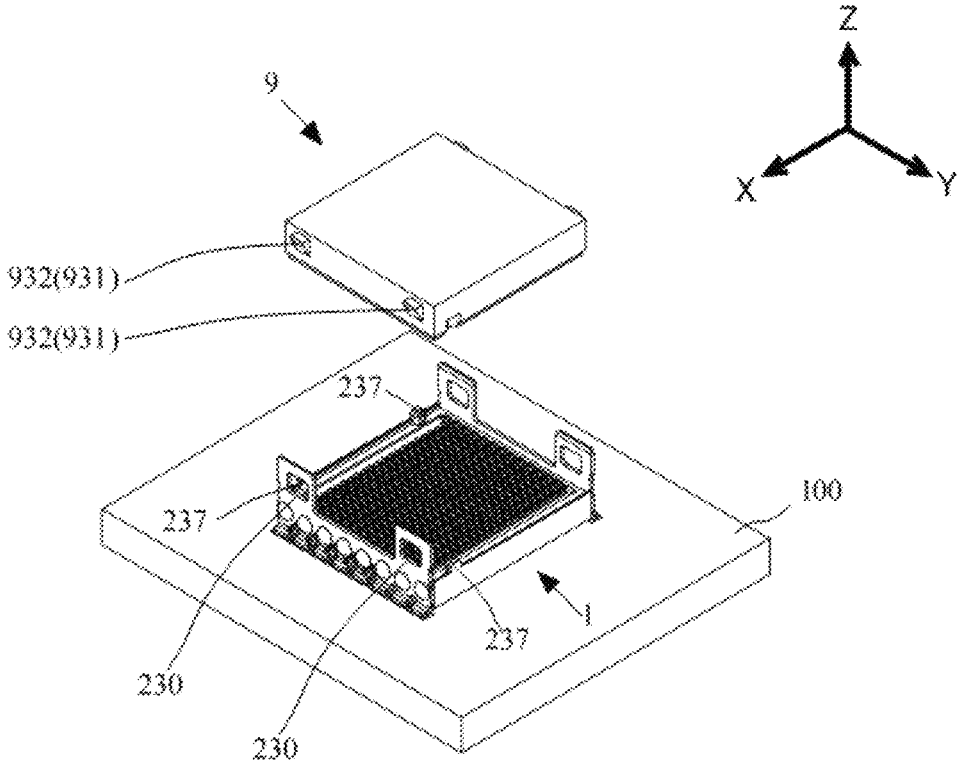
FIGS. 14A and 14B illustrate a diagram showing an appearance of fitting the IC package to the socket on the circuit board of FIG. 11B.
Figure 14B:
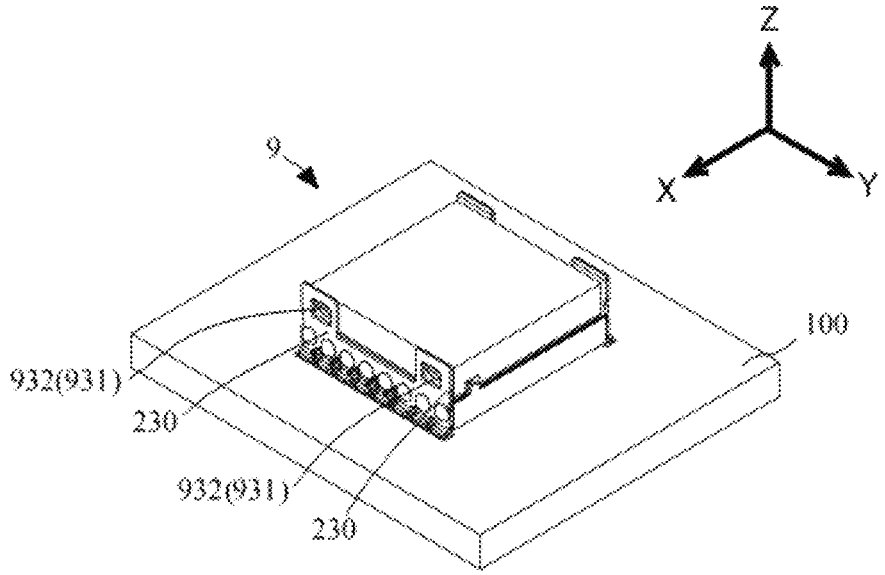

As shown in FIG. 12A and FIG. 12B, the IC package 9 is in an approximately rectangular parallelepiped shape with the same dimensions as the cap 8. As shown in FIG. 13, the IC package 9 has a screw 91, a first mechanical plate 92, two lock plates 93, two coil springs 94, a second mechanical plate 95, and a printed board 96. The first mechanical plate 92 serves as a housing to hold the lock plates 93, the coil springs 94, the second mechanical plate 95, and the printed board 96.

The first mechanical plate 92 is in a box shape opened on the lower side. A round hole 920 is provided in the center of the upper board of the first mechanical plate 92, and rectangular holes 923 are provided on the +X side and the −X side of the round hole 920. Rectangular holes 921 are provided at respective positions apart from each other on the +Y side and the −Y side in each of the side boards on the +X side and the −X side of the first mechanical plate 92.

A rectangular hole 933 is provided in the center of the lock plate 93 on the +X side. The inner wall surface on the −X side of the rectangular hole 933 of the lock plate 93 on the +X side is inclined to the +X side with respect to the Z direction. Substantially triangular prism-shaped protruding pieces 931 are provided at positions apart from each other on the +Y side and the −Y side on the outer surface of the +X side of the lock plate 93 on the +X side. Upwardly recessed grooves 934 are provided at respective positions apart from each on the +Y side and the −Y side in the lower surface of the lock plate 93 on the +X side. The +X side of the groove 934 is open and the −X side is blocked. The lock plate 93 on the −X side has a mirror-symmetrical structure with the lock plate 93 on the +X side.

A screw pedestal 958 is provided in the center of the second mechanical plate 95. A screw hole 950 is provided in the screw pedestal 958. Positioning grooves 957 are provided at a position near to the +X side of one corner of the second mechanical plate 95, and positions away from this position on the +X side and the +Y side. Positioning grooves 967 are provided at a position near to the +X side of one corner of the printed board 96, and positions away from this position on the +X side and the +Y side.

The second mechanical plate 95 and the printed board 96 are bonded so that the positioning grooves 957 and the positioning grooves 967 are aligned. Two lock plates 93 on the +X side and the −X side and the coil springs 94 accommodated in the grooves 934 thereof are placed around the screw pedestal 958 on the second mechanical plate 95, and these members are covered by the first mechanical plate 92.

The rectangular hole 933 of the lock plate 93 locates on the lower side of the rectangular hole 923 of the first mechanical plate 92. The screw 91 passes through the round hole 920 of the lock plate 93 and is screwed into the screw hole 950 of the second mechanical plate 95. An outward urging force is applied to the lock plate 93 on the +X side and the lock plate 93 on the −X side by the coil springs 94, which are elastic bodies, in the grooves 934 of both lock plates.

The outer surface of the lock plate 93 on the +X side abuts the inner surface of the side board on the +X side of the first mechanical plate 92. The protruding piece 931 of the lock plate 93 on the +X side is supported movably forward and backward at the rectangular hole 921 of the side board on the +X side of the first mechanical plate 92. This protruding piece 931 protrudes to the +X side from the rectangular hole 921.

The outer surface of the lock plate 93 on the −X side abuts the inner surface of the side board on the −X side of the first mechanical plate 92. The protruding piece 931 of the lock plate 93 on the −X side is supported movably forward and backward at the rectangular hole 921 of the side board on the −X side of the first mechanical plate 92. This protruding piece 931 protrudes to the −X side from the rectangular hole 921.

Figure 15A:
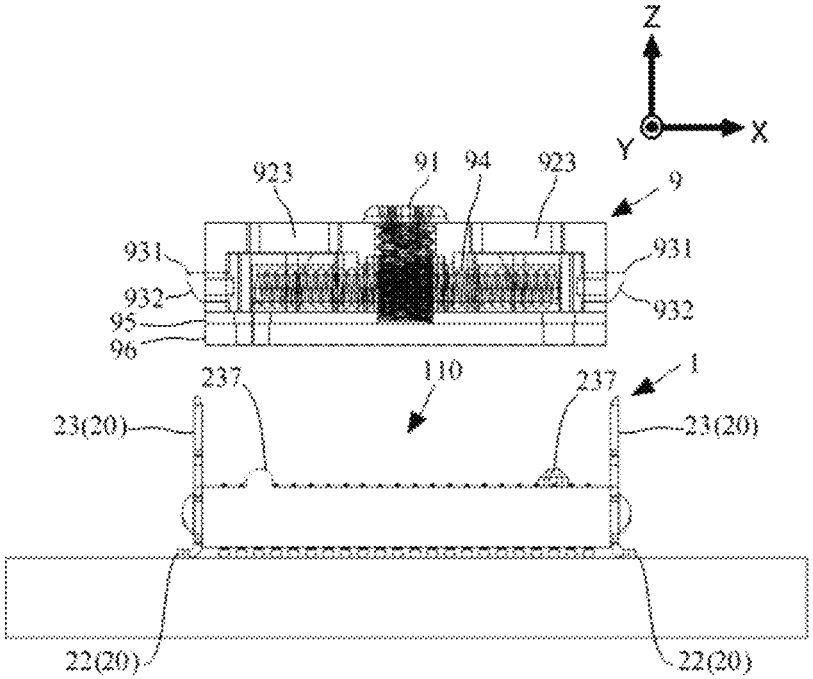
FIGS. 15A and 15B illustrate a diagram showing the shrinkage of the coil spring when the IC package of FIG. 13A is fitted to the socket.
Figure 15B:
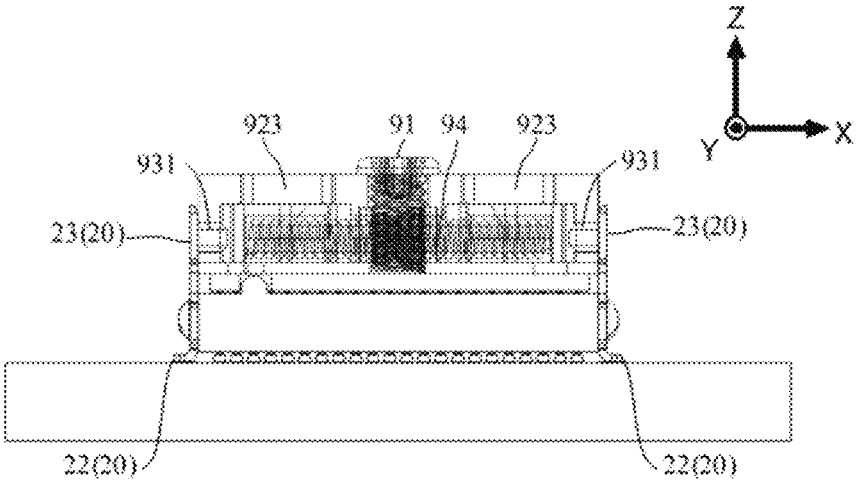

As shown in FIGS. 15A-15B, when the IC package 9 is fitted and pressed down between the protruding portion 23 on the −X side and the protruding portion 23 on the +X side from the above of the opening 110 of the socket 1, the protruding portions 23 push the protruding pieces 931 while sliding on the tapered surfaces 932 of the protruding pieces 931 of the IC package 9, and the protruding pieces 931 evacuate inward against the urging force of the coil spring 94.

When the IC package 9 is further pressed down, the protruding pieces 931 of the IC package 9 are fitted to the support holes 230 of the socket 1, three positioning pins 237 of the socket 1 are fitted to the three positioning grooves 957 and 967 of the IC package 9, and the IC package 9 is supported by the holders 20 of the socket 1. Thereby, mounting the IC package 9 onto the socket 1 is completed.

Figure 16A:
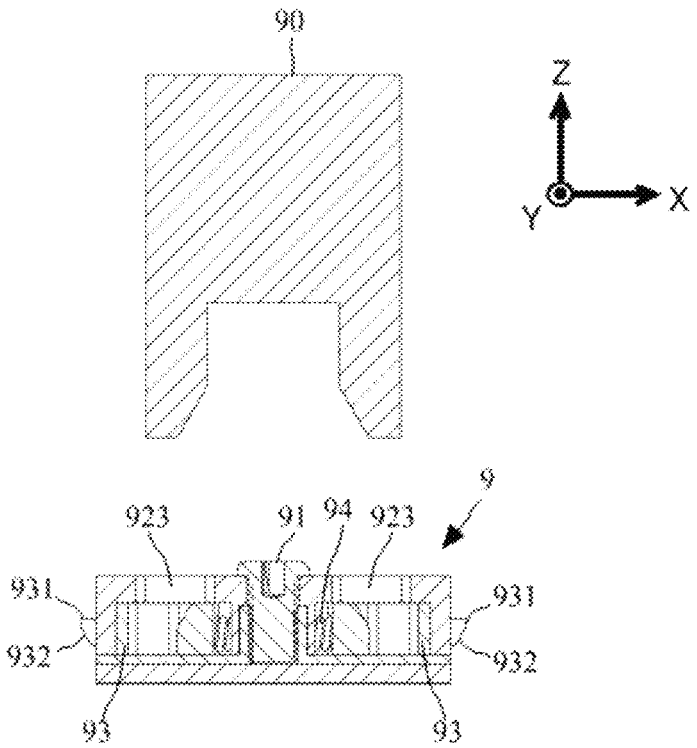
FIGS. 16A and 16B illustrate a diagram showing the shrinkage of the coil spring when the IC package of FIG. 13A is removed from the socket.
Figure 16B:
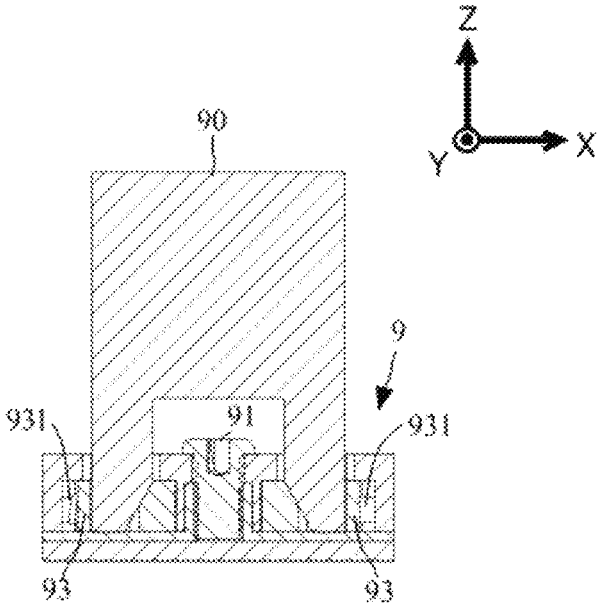

As shown in FIGS. 16A-16B, when a portion of the remover 90 branched into two is fitted and pressed down to the rectangular holes 933 of the lock plates 93 of the IC package 9, it pushes the lock plates 93 while sliding on the inner wall surfaces of the rectangular holes 933 of the lock plates 93 of the remover 90, and the lock plates 93 evacuate inward against the urging force of the coil spring 94. In this state, the IC package 9 can be removed from the socket 1 by lifting the IC package 9.

The above is the details of the present embodiment. The socket 1 according to the present embodiment includes: a housing 10 in a box shape with an opening 110 and being provided with a matrix of penetration holes 17-*i* (i=1 to 22)-j (j=1 to 13) at a bottom portion 13; a plurality of contacts 7 including respective pairs of contacts 7(N) and 7(P) for high-speed differential transmission and contacts for ground 7(G); a plurality of insulating members 40, 50 supporting a plurality of contacts 7 and being pressed into the housing 10 so that the contacts 7 are exposed on the opposite side of the opening 110 from the penetration holes 17-*i* (i=1 to 22)-j (j=1 to 13) of the housing 10; and a plurality of conductive resin members 60 fitted to positions of a plurality of insulating members 40, 50 in contact with the contacts for ground 7(G). And the respective pairs of the contacts 7(N) and 7(P) for high-speed differential transmission are arranged apart from each other in the row direction and the column direction of the a matrix. The contacts for ground 7(G) are arranged at the adjacent positions in the row direction and the adjacent positions in the column direction in each of the respective pairs of the contacts 7(N) and 7(P) for high-speed differential transmission to surround the pairs. Thus, the occurrence of crosstalk of high-speed differential transmission by the contacts 7(N) and contact 7(P) can be more reliably prevented.

Further, the socket 1 according to the present embodiment includes: a bottom portion 13 which forms the bottom of the opening 110 accommodating the IC package 9 and is provided with a plurality of penetration holes 17-*i* (i=1 to 22)-j (j=1 to 13); a housing 10 having two pairs of side wall portions 11, 12 facing each other across the opening 110, wherein a plurality of ribs 120*a*, 120*b*, 120*c*, 120*d*, 120*e*, 120*f*, 120*g*, 120*h* protruding outward are provided on one pair of side wall portions 12; a plurality of contacts 7 supported by the housing 10 in such a way that these contacts 7 pass through a plurality of penetration holes 17-*i* (i=1 to 22)-j (j=1 to 13) and are exposed on the opposite side of the opening 110; and holders 20 with a plurality of support holes, wherein ribs 120*a*, 120*b*, 120*c*, 120*d*, 120*e*, 120*f*, 120*g*, 120*h* pass through the support holes, and the holders 20 fixed to the side surfaces of the housing 10. Then, a portion of the lower end of the holder 20 extends downward below the lower end of the housing 10 and is bent outward. This bent portion forms a mounting surface to be soldered to the circuit board 100. Thus, even if the solder is melt due to reflow, the socket 1 is held on the circuit board 100 by the lower end portion of the holder 20, so that the solder does no move up and down and the contact 7 does not sink. Therefore, a socket 1 with high positioning accuracy of the contacts 7 can be provided.

Although the embodiment of the present disclosure has been described above, the following modifications may be added to this embodiment.

(1) In the above embodiment, the penetration holes 17-*i*-*j* and the contacts 7 of the socket 1 were 22 rows and 13 columns. However, the number of rows of the penetration holes 17-*i*-*j* and the contacts 7 may be more than 22 rows or less than 22 rows. Further, the number of columns of the penetration holes 17-*i*-*j* and the contacts 7 may be more than 13 columns or less than 13 columns.

(2) In the above embodiment, the number of the support holes and the protruding portions 22*a*, 22*b*, 22*c*, 22*d*, 22*e*, 22*f*, 22*g*, 22*h* on the +Y side and −Y side of the lower end of the holder 20 may be 2 to 7, or may be 9 or more.

(3) In the above embodiment, the conductivity of the conductive resin member 60 may be in a different range from 20 S/m to 200 S/m. The conductivity of the conductive resin member 60 is preferably in a range of 5 S/m to 1000 S/m.

(4) In the above embodiment, a plurality of conductive resin members 60 in contact with a plurality of contacts for ground 7(G) surrounding the respective pairs of the contacts 7(N) and the contacts 7 (P) may be apart from each other without being in contact with each other.

What is claimed is:

1. A socket, comprising:

a housing that is in a box shape with an opening and is provided with a matrix of penetration holes at a bottom portion;

a plurality of contacts comprising contacts for ground and respective pairs of contacts for high-speed differential transmission;

a plurality of insulating members which support the plurality of contacts and are pressed into the housing in such a manner that the contacts are exposed on an opposite side of the opening from the penetration holes of the housing; and a plurality of conductive resin members fitted at positions of the plurality of insulating members in contact with the contacts for ground, wherein the respective pairs of contacts for high-speed differential transmission are arranged apart from each other in a row direction and a column direction of the matrix, the contacts for ground are separately arranged at adjacent positions in the row direction and adjacent positions in the column direction in each of the respective pairs of contacts for high-speed differential transmission to surround the pairs, the housing comprises two pairs of side wall portions facing each other across the opening, and grooves are provided on both sides of each column of the penetration holes in one pair of side wall portions, and the insulating members and the plurality of conductive resin members are formed by insertion molding in the plurality of contacts as assembly bodies corresponding to respective columns, and the insulating members of the assembly bodies of the respective columns are pressed into the grooves.

2. The socket according to claim 1, wherein the insulating member is LCP.

3. The socket according to claim 1, wherein a conductivity of the conductive resin member is 5 S/m to 1000 S/m.

4. The socket according to claim 1, wherein the plurality of conductive resin members in contact with a plurality of contacts for ground surrounding each of the respective pairs are in contact with each other.

5. The socket according to claim 1, wherein the contact for high-speed differential transmission penetrates a portion of the insulating member to which the conductive resin member is not fitted and is supported at this portion, and the contact for ground penetrates a portion of the insulating member to which the conductive resin member is fitted and is supported at this portion.

6. The socket according to claim 1, wherein the insulating member is in a rectangular parallelepiped-shape with a plurality of concave portions apart from each other in the row direction, the conductive resin member is in a shape having a width in the column direction, which is the same as the concave portion, and the conductive resin member is fitted to the concave portion of the insulating member.

7. The socket according to claim 1, wherein positions of the conductive resin member on a front side of the column direction and positions of the conductive resin member on the rear side of the column direction are offset in the row direction by three contacts.

8. A socket, comprising:

a housing that is in a box shape with an opening and is provided with a matrix of penetration holes at a bottom portion;

a plurality of contacts comprising contacts for ground and respective pairs of contacts for high-speed differential transmission;

a plurality of insulating members which support the plurality of contacts and are pressed into the housing in such a manner that the contacts are exposed on an opposite side of the opening from the penetration holes of the housing; and a plurality of conductive resin members fitted at positions of the plurality of insulating members in contact with the contacts for ground, wherein the respective pairs of contacts for high-speed differential transmission are arranged apart from each other in a row direction and a column direction of the matrix, the contacts for ground are separately arranged at adjacent positions in the row direction and adjacent positions in the column direction in each of the respective pairs of contacts for high-speed differential transmission to surround the pairs, a width of the conductive resin member in the column direction is larger than a width of the insulating member in the column direction, a convex portion is provided on a front surface of the conductive resin member, and the convex portion of the conductive resin member on a rear side of the column direction is abutted to a rear surface of the conductive resin member on a front side of the column direction.

9. A socket, comprising:

a housing that is in a box shape with an opening and is provided with a matrix of penetration holes at a bottom portion;

a plurality of contacts comprising contacts for ground and respective pairs of contacts for high-speed differential transmission;

a plurality of insulating members which support the plurality of contacts and are pressed into the housing in such a manner that the contacts are exposed on an opposite side of the opening from the penetration holes of the housing; and a plurality of conductive resin members fitted at positions of the plurality of insulating members in contact with the contacts for ground, a base portion extending in a straight line;

a solder connecting portion bent in an L-shape at a lower end of the base portion; and an inclined portion bent at an obtuse angle and extending with respect to the base portion at an upper end of the base portion, wherein the respective pairs of contacts for high-speed differential transmission are arranged apart from each other in a row direction and a column direction of the matrix, the contacts for ground are separately arranged at adjacent positions in the row direction and adjacent positions in the column direction in each of the respective pairs of contacts for high-speed differential transmission to surround the pairs, a solder ball is fixed to the solder connecting portion and the base portion of the contact passes through the penetration hole and extends downward, and the solder connecting portion and the solder ball are exposed on a lower side of the bottom portion.

10. The socket according to claim 9, wherein tapered surfaces inclined to the inclined portion side are provided at a corner portion where a front surface and an upper surface of the plurality of conductive resin members intersect with each other and the corner portion where a rear surface and a lower surface intersect with each other.

* * * * *